United States Patent [19]

Staat et al.

[11] Patent Number: 4,928,507

[45] Date of Patent: May 29, 1990

[54] METHODS AND APPARATUS FOR MANUFACTURING SEAMLESS TUBE

[75] Inventors: Karlhans Staat, Ratingen; Hermann Möltner, Grevenbroich, both of Fed. Rep. of Germany

[73] Assignee: Kocks Technik GmbH & Co., Fed. Rep. of Germany

[21] Appl. No.: 137,463

[22] Filed: Dec. 23, 1987

Related U.S. Application Data

[63] Continuation of Ser. No. 770,730, Aug. 29, 1985, abandoned.

[30] Foreign Application Priority Data

Sep. 1, 1984 [DE] Fed. Rep. of Germany ..... 3432288

[51] Int. Cl.[5] ..... B21B 9/00; B21B 19/04; B21B 19/10

[52] U.S. Cl. ..... 72/38; 72/96; 72/97; 72/358

[58] Field of Search ..... 72/38, 96, 97, 325, 72/359, 273, 206, 209, 39, 42, 358

[56] References Cited

U.S. PATENT DOCUMENTS

| | | | |
|---|---|---|---|
| 1,682,724 | 8/1928 | Bungeroth | 72/97 |
| 1,784,791 | 12/1930 | Gruber | 72/97 |
| 1,936,790 | 11/1933 | Heetkamp | 72/209 |
| 2,017,389 | 10/1935 | Bark et al. | 72/38 |
| 2,025,439 | 12/1935 | Brownstein | 72/208 |
| 2,031,014 | 2/1936 | Staples | 72/38 |
| 2,363,476 | 11/1944 | Bannister | 72/38 |
| 3,196,648 | 7/1965 | Molnar | 72/38 |
| 3,350,906 | 11/1967 | Levinson et al. | 72/38 |
| 3,374,650 | 3/1968 | Calmes | 72/39 |
| 3,893,318 | 7/1975 | King, Jr. et al. | 72/38 |
| 4,368,630 | 1/1983 | Uhlmann et al. | 72/97 |
| 4,393,566 | 7/1983 | Uhlmann et al. | 72/38 |
| 4,578,974 | 4/1986 | Pozsgay et al. | 72/96 |

FOREIGN PATENT DOCUMENTS

| | | | |
|---|---|---|---|
| 1027623 | 10/1958 | Fed. Rep. of Germany | 72/201 |
| 2356985 | 5/1975 | Fed. Rep. of Germany | 72/38 |
| 2929401 | 2/1981 | Fed. Rep. of Germany | 72/38 |
| 43164 | 4/1979 | Japan | 72/209 |
| 120405 | 9/1980 | Japan | 72/38 |
| 105804 | 8/1981 | Japan | 72/201 |
| 35005 | 3/1983 | Japan | 72/38 |
| 157544 | 9/1983 | Japan | 72/38 |
| 33010 | 2/1984 | Japan | 72/38 |
| 59-33011 | 8/1984 | Japan . | |
| 33807 | 2/1985 | Japan | 72/97 |
| 284801 | 12/1977 | U.S.S.R. | 72/96 |
| 2099738 | 12/1982 | United Kingdom | 72/38 |
| 2105627 | 3/1983 | United Kingdom | 72/97 |
| 2135336 | 8/1984 | United Kingdom | 72/38 |

*Primary Examiner*—Robert L. Spruill
*Attorney, Agent, or Firm*—Buchanan Ingersoll

[57] ABSTRACT

Ingots hot from rolling are pierced to form a hollow ingot by means of an internal tool of a press or skew-rolling line, and are subsequently elongated to form a tubular bloom by a stretching unit provided with a mandrel rod, and are finally finish-rolled. When inserting or withdrawing the internal tool into or out of the hollow ingot or the mandrel rod into or out of the tubular bloom, inert gas is introduced into the freed interior space in order to prevent scaling of the interior wall of the tubular bloom.

7 Claims, 3 Drawing Sheets

METHODS AND APPARATUS FOR MANUFACTURING SEAMLESS TUBE

This application is a continuation of our copending application Ser. No. 770,730, filed Aug. 29, 1985, now abandoned.

The invention relates to a method of an apparatus for manufacturing seamless tubes.

In known methods and apparatus, ingots hot from rolling are pierced by means of an internal tool or a press or skew-rolling line to form a hollow ingot, and are subsequently elongated by a stretching unit, such as a push bench or rolling line, provided with a mandrel rod to form the tubular bloom, and are finally finish-rolled.

A large number of different methods of this kind are known, but generally have the above-mentioned features. Hence, when using a press and when using a skew-rolling line, the ingots are placed by means of an internal tool which, for example, in the case of a piercing press, comprises the piercing mandrel, whereas, in the case of skew-rolling line, the internal tool comprises a shaft rod on the end of which is mounted a plug having a diameter which is somewhat larger than that of the shaft rod. The hollow ingots produced in this manner are then elongated to form a tubular bloom in a second process step performed on different kinds of rolling lines or on a push bench. The stretching units, however different they may be, have the common feature that the hollow ingot is elongated by a mandrel rod or plug rod which is inserted before elongation after the internal tool used during piercing has been withdrawn, or the shaft rod, freed from the plug, of the skew-rolling line used for piercing is involved which is left in the hollow ingot after the piercing operation. When a push bench is used for elongation of the hollow ingot to form the tubular bloom, an abutment in the hollow ingot must be offered to the leading end face of the mandrel rod. In the case of hollow ingots produced on piercing presses, this abutment is the bottom of the hollow ingot closing the end of the bore, whereas hollow ingots produced on a skew-rolling line do not have such a bottom, but, before stretching to form the tubular bloom, receive the abutment for the mandrel rod by swageing at an end portion, a special internal tool generally being required for this swageing operation.

These known methods lead to considerable scaling of the hollow ingot and of the tubular bloom, this also applying to their interior wall where the layer of scale is particularly disadvantageous, since it is difficult to remove, particularly in the case of longer lengths. The interior wall has intensive contact with the atmospheric oxygen, particularly by virtue of the fact that the internal tool or the mandrel rod is withdrawn from the hollow ingot or from the tubular bloom after the ingot has been pierced to form the hollow ingot and also after it has been elongated to form the tubular bloom. Suction then occurs in the bore and draws air into the bore and causes scaling of the interior wall. Scaling of the interior wall is particularly disadvantageous when it occurs before elongation to form the tubular bloom, since the layer of scale then existing between the inserted mandrel rod of the stretching unit and the work-material is pressed into the wall of the tubular bloom by the stretching unit during deformation to form the tubular bloom, hence leading to a rough and uneven interior wall of the tubular bloom in the first instance. This cannot be eliminated during finish-rolling by, for example, a stretch-reducing rolling mill which operates without an internal tool, so that the finished tubes also have a rough interior wall. Furthermore, this layer of scale causes increased wear on the expensive mandrel rods of the stretching units, which results in a corresponding increase in the operating costs.

Owing to these disadvantages, it has already been proposed to leave the internal tool used for piercing, such as the shaft rod of the skew-rolling line, in the hollow ingot and subsequently to use it as a mandrel rod in the stretching unit. Although this largely prevents the intrustion of air into the bore in the hollow ingot, and thus scaling of its interior wall, it at the same time also constitutes a high thermal stress on this rod owing to its long time in contact with the work-material. The leading end portion of the rod soon acquires the same temperature as the work-material, particularly during pushing, so that it is solely due to the high resistance to heat of the rod that substantially only the hollow ingot is deformed. When it is taken into consideration that the mandrel rod drives the hollow ingot in a push bench and is therefore subjected to particularly high mechanical stress, it will be appreciated that the mandrel rods are subjected to a considerable amount of wear. In addition to this, in many cases, the leading end portions of the mandrel rods are also used a internal tools when swaging an abutment for a mandrel rod under the high thermal and mechanical stress, and are subjected to additional stress. Furthermore, the internally water-cooled rod which is cold during insertion draws a large quantity of heat from the work-material during the long contact time, hence rendering deformation difficult and increasing the stress on the stretching units in the case of a high energy requirement. Finally, it is a difficult matter to apply the lubricating film, required only during stretching, permanently to the shaft rod and the subsequent mandrel rod before piercing.

The last-mentioned difficulties can be avoided when different rods are used for piercing and stretching, although this has the disadvantage of considerable scaling of the interior wall. Hence, the object of the invention is to avoid such scaling.

Accordingly the invention resides in a method of manufacturing seamless tubes, in which ingots hot from rolling are pieced by means of an internal tool of a press or skew-rolling line to form a hollow ingot, and are subsequently elongated to form the tubular bloom by a stretching unit having a mandrel rod and are finally finish-rolled, and in which, when introducing or withdrawing the internal tool into or out of the hollow ingot and/or the mandrel rod into or out of the tubular bloom, an inert or non-oxidising gas is at the same time introduced into the vacated interior space in the hollow ingot or in the tubular bloom.

This inert gas displaces the air and hence the oxygen from the interior space of the hollow ingot or of the tubular bloom or prevents the air from entering the interior space, so that scaling of the interior wall does not occur. Hence, a satisfactory surface of the interior wall is maintained up to the finished tube. Increased wear on the mandrel rod as a result of the abrasive action of the scale is avoided, hence resulting in a perceptible decrease in the operating costs. Furthermore, there is no longer any need to leave the internal tool in the hollow ingot after piercing out of consideration for the avoidance of scaling, and the tool may be withdrawn without the risk of intrusion of air into the interior space. The internal tools are thereby protected, since they are not subjected to the considerable increase in temperature and high mechanical stress which otherwise occur when the same internal tool is used, for example, during swaging and pushing and not only during piercing. Finally, the withdrawal of the internal tool has an advantageous effect on the temperature of the hollow ingot, since short contact times are achieved and therefore less heat is dissipated from the hollow ingot by way of the internal tool.

It is advantageous if the inert gas is drawn into the hollow ingot or the tubular bloom chiefly by the suction occurring upon withdrawal of the internal tool or the mandrel rod. By way of example, the inert gas may be introduced through bores in the internal tool or in the mandrel rod. In the event of the hollow ingot or the tubular bloom having an opening in the region of its bottom, or an open end, the inert gas can be sucked into the interior space through the said opening or open end. It may be advisable to subject the inert gas to a slight excess pressure in order to assist the sucking of the inert gas into the interior space. Deoxidising agents can be introduced into the interior space of the hollow ingot instead of an inert gas, or together therewith, to bond any residual oxygen still present. The inert gas, and possible the deoxidising agent, remains in the interior space or the hollow ingot or of the tubular bloom for some time after the internal tool has been withdrawn, since a more or less closed bottom frequently prevents the egress of the inert gas. Even intermediate stretching of the hollow ingot on a hollow ingot rolling line without an internal tool would not remove the inert gas from the interior space. It is advantageous if the hollow ingot or the tubular bloom is conveyed substantially only transversely of the longitudinal direction after introduction of the inert gas. This avoids flows of air which would displace the inert gas from the interior space.

The invention includes a plant for manufacturing seamless tubes, having a press or a skew-rolling line provided with an internal tool for piercing and a stretching unit provided with a mandrel rod, the internal tool for piercing, swageing or stretching having an axial feed bore for a non-oxidising or inert gas, which bore leads to an open end of the tool and/or opens into substantially radial outlet bores in the tool.

All the inert gas may be fed through these bores, or alternatively, only a portion thereof, the latter particularly when the bottom of the hollow ingot or of the tubular bloom has a suitable opening and communicates with a reservoir for inert gas.

The invention also includes a plant for manufacturing seamless tubes having a press or a skew-rolling line provided with an internal tool for piercing, a stretch unit provided with a mandrel rod, and a tool or filling tube for feeding a non-oxidising or inert gas in an axial direction and for engaging the end face of the hollow ingot or the tubular bloom.

It will be appreciated that, in this case, the hollow ingot or the tubular bloom must be open at the relevant end face or have at least a through opening.

The invention is further described, by way of example, with reference to the accompanying drawings, in which.

Figure 5:
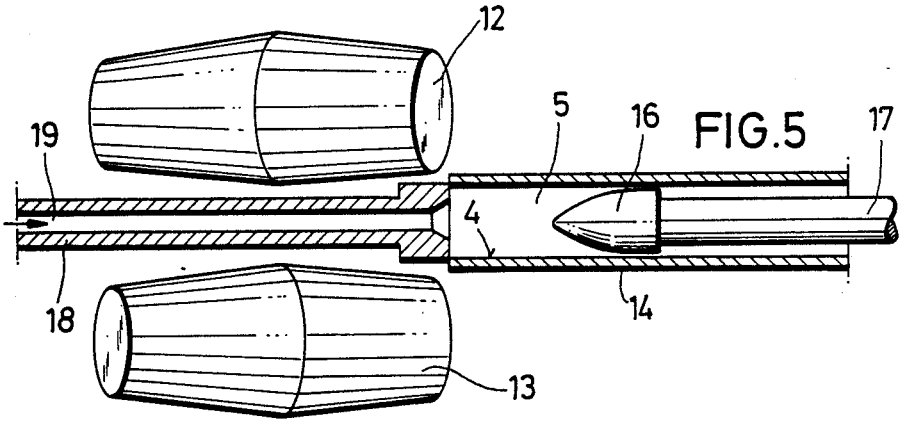
Figure 6A:
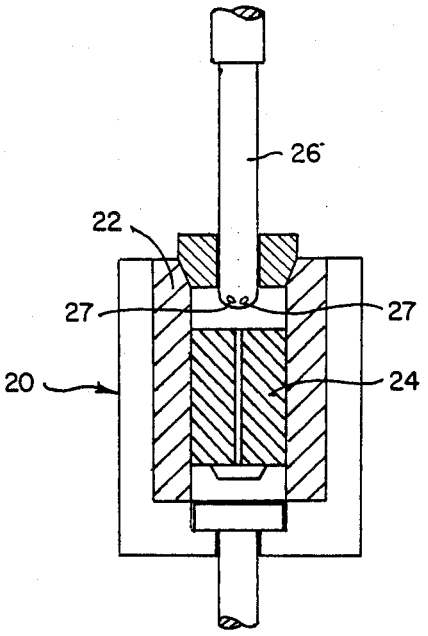
Figure 6B:
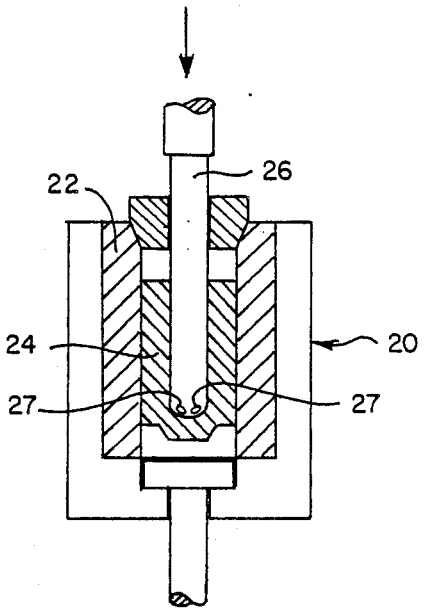
Figure 7:
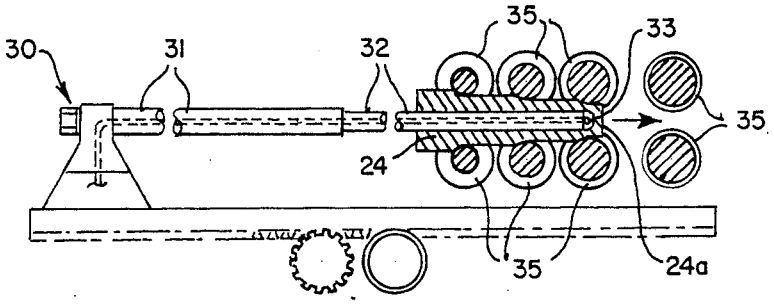

FIGS. 6*a* and 6*b* show the formation of a hollow ingot by a piercing mandrel of a press; and FIG. 7 shows elongation of the hollow ingot of FIG. 5 on a push bench.

Figure 1:
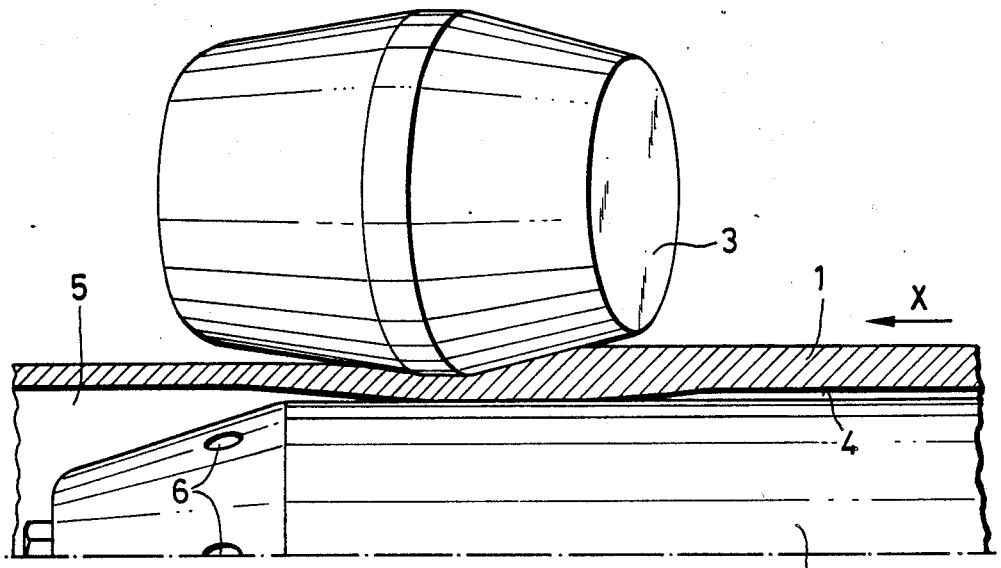
FIG. 1 is a diagrammatic sectional view showing a tubular bloom having a mandrel rod located in the interior thereof, during stretching in a skew-rolling line in accordance with one embodiment of the present invention.

Referring to FIG. 1, a mandrel rod 2 is inserted into a tubular bloom 1. The mandrel rod 2 serves as an internal tool during the stretching operation which, in the present embodiment is performed on a skew-rolling line. Only one skew-roll 3 of the rolling line is shown in FIG. 1. It will also be seen that the mandrel rod 2 fills substantially the entire interior space 5 of the tubular bloom 1 in the rolling direction X upstream of the skew-roll 3, this applying entirely to a portion of the region in which the skew-roll 3 engages the tubular bloom 1. Consequently, atmospheric oxygen is largely kept away from the interior wall 4 of the tubular bloom 1, and the formation of scale is avoided. A larger interior space 5 occurs only between the interior wall 4 of the tubular bloom 1 and the mandrel rod 2 downstream of the skew-roll 3 in the rolling direction X, and would be filled with air if inert gas did not displace this air and hence also the oxygen in the air, as is done in accordance with the invention. The inert gas is blown into the interior space 5 through outlet bores 6 provided in the head of the mandrel rod 2.

Figure 2:
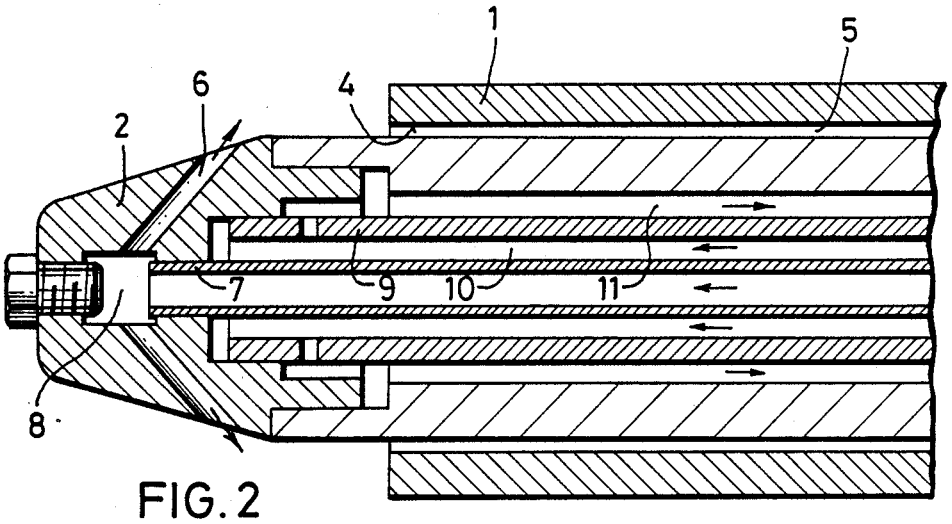
FIG. 2 shows the tubular bloom with mandrel rod of FIG. 1 before stretching.

Only one of these bores is shown in section in FIG. 2, and a feed tube 7 may be seen through which the inert gas is fed to a manifold chamber 8 from which it may flow into the interior space 5 of the tubular bloom 1 through the outlet bores 6. The feed tube 7 for the inert gas is surrounded by a water feed tube 9 which forms two annular chambers 10 and 11 through which cooling water is fed and discharged, hence ensuring adequate cooling of the mandrel rod 2.

Figure 3:
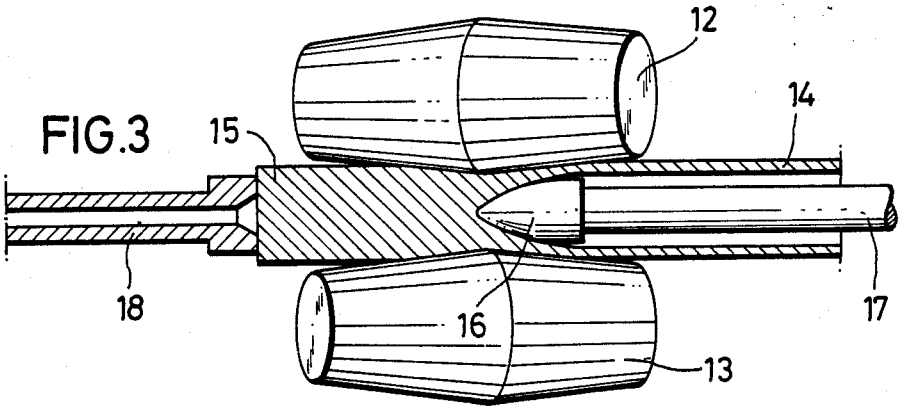
FIGS. 3 to 5 are sectional views showing a hollow ingot with a plug rod located in the interior thereof during piercing in a skew-rolling mill in different operating states, in accordance with a second embodiment of the invention.
Figure 4:
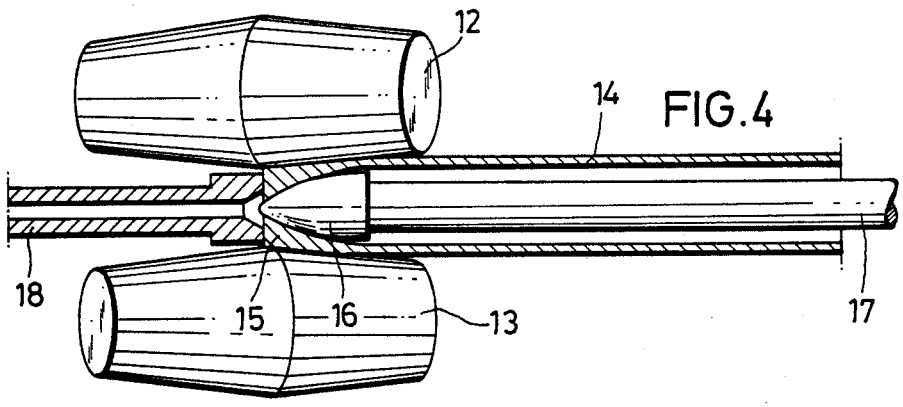

FIG. 3 shows two skew rolls 12 and 13 which produce a hollow ingot 14 from an ingot introduced at the entry end. The skew rolls 12 and 13 roll the hollow ingot 14 over a plug 16 of a plug rod 7, the advance movement being produced in a conventional manner by the skew rolls 12 and 13. A ram 18 serves to push the ingot 15 between the skew rolls 12 and 13 chiefly only at the commencement of the rolling operation. However, the end of the rolling operation is illustrated, and the ram 18 has again been pushed against the trailing end face of the ingot 15. It follows the advance movement of the ingot 15, as is shown in FIG. 4. FIG. 5 shows that the ram 18 follows the work-material through the narrowest cross-sectional area between the rolls 12 and 13, that is to say, after the actual rolling operation has been terminated. The skew rolls 12 and 13 no longer engage the hollow ingot 14, and the plug rod 17 with the plug 16 is gradually withdrawn from the hollow ingot 14. Inert gas flows through an internal bore 19 in the ram 18 and through the now open end face of the hollow ingot 14 into the interior space 5 thereof, displaces any residual air which has entered the said interior space and, in particular, prevents air from being drawn in and hence scaling of the interior wall 4. In order to prevent air from entering the interior space 5 in the hollow ingot 14 downstream of the plug 16 during the rolling operation, it is also possible to introduce inert gas into this portion of the interior space 5 through the plug rod 17 in the same manner as is illustrated in FIGS. 1 and 2. The plug rod 17 then has in the region of the plug 16, outlet bores similar to the bores 6 of FIGS. 1 and 2.

FIGS. 6*a* and 6*b* illustrate the operation of press 20. As shown in FIG. 6*a*, a hot ingot is provided within die 22 of press 20 and as shown in FIG. 6*b*, an internal piercing tool in the form of a piercing mandrel 26 is utilized to pierce the hot ingot to form a hollow ingot. Piercing mandrel 26 is provided with an internal passageway leading to bores 27 for the simultaneous introduction of either an inert gas or an non-oxidizing gas through mandrel 26 into the space within the hollow ingot being vacated by the withdrawal of mandrel 26 as mandrel 26 is withdrawn from die 22.

As piercing mandrel 26 is withdrawn from the hollow ingot 24 an inert gas or a non-oxidizing gas may be blown into the hollow ingot so that its inner walls cannot form a scale. Then, as shown in FIG. 7, the pierced ingot 24 is conveyed to a push bench 30 at which a shaft rod 31 and an mandrel rod 32 are utilized to push hollow ingot 24 through rollers 35 to elongate the hollow ingot 24 for form a tubular bloom. Closed end 24*a* of the hollow ingot 24 provides an abutment which may be engaged by end 33 of mandrel rod 32 to provide a means for pushing the hollow ingot through the rollers 35. As shown in FIG. 7, the dashed lines extending through shaft rod 31 and mandrel rod 32 indicate a longitudinal borehole for the passage of an inert gas from a reservoir, not shown, to bores entering end 33 of mandrel rod 32 to provide inert gas into the inner space of ingot 24 as mandrel rod 32 is withdrawn.

We claim:

1. A method of manufacturing seamless tubes in a skew rolling line comprising:

(a) abutting a hot ingot with a hollow ram to at least initially push the ingot into the skew rolling line for piercing;

(b) piercing the hot ingot by means of an internal piercing tool comprising an elongated piercing rod having a plug of enlarged diameter compared to said rod at its forward end in the skew rolling line to form a hollow ingot;

(c) withdrawing the piercing tool from said hollow ingot; and (d) simultaneously introducing one of an inert gas and a non-oxidizing gas through an opening in the hollow ram into the space within the hollow ingot being vacated by withdrawal of the piercing tool as said piercing tool is withdrawn.

2. A plant for manufacturing seamless tubes in a skew rolling line comprising:

(a) a hollow pushing ram for at least initially pushing an ingot into the skew rolling line for piercing;

(b) an internal piercing tool comprising an elongated piercing rod having a plug of enlarged diameter compared to said rod at its forward end for piercing said ingot in said skew rolling line to form a hollow ingot;

(c) said hollow pushing ram having an opening at its forward end for introducing one of an inert gas and a non-oxidizing gas through said opening into the space within the hollow ingot being vacated by withdrawal of the piercing tool as the piercing tool is withdrawn; and (d) a source of inert gas or non-oxidizing gas connected to the opening in said hollow pushing ram.

3. A method of manufacturing seamless tubes comprising the steps of:

(a) piercing hot ingots by means of an internal piercing tool comprising an elongated piercing rod in one of a press and a skew rolling line to form a hollow ingot;

(b) withdrawing the piercing tool from said hollow ingot;

(c) simultaneously introducing one of an inert gas and a non-oxidizing gas through a borehole in the forward end of said piercing tool into the space within the hollow ingot being vacated by the withdrawal of the piercing tool as said piercing tool is withdrawn whereby said hollow ingot is filled with said gas when said piercing tool is withdrawn.

4. A plant for the manufacture of seamless tubes comprising:

(a) one of a press and skew-rolling line having an internal piercing tool for piercing an ingot to form a hollow ingot with said tool for the skew-rolling line having a plug;

(b) at least one borehole in the forward end of the piercing tool of said press and in the forward end of said plug; and (c) gas delivery means for introducing through said at least one borehole one of an inert and a non-oxidizing gas into the space within said hollow ingot being vacated by withdrawal of said piercing tool whereby said hollow ingot is filled with an inert or a non-oxidizing gas as said piercing tool is withdrawn.

5. A method of manufacturing seamless tubes comprising;

(a) piercing hot ingots to form hollow ingots in a piercing unit;

(b) stretching said hollow ingots in a stretching unit employing an internal mandrel rod having a head at its forward end with at least one opening in said head to form a tube bloom; and (c) withdrawing said mandrel rod from said tube bloom while simultaneously introducing one of an inert gas and a non-oxidizing gas through said at least one opening into the space being evacuated by said mandrel rod as said mandrel rod is being withdrawn.

6. A plant for manufacturing seamless tubes including a piercing unit and a stretching unit wherein said stretching unit receives hollow ingots from said piercing unit and wherein said stretching unit comprises:

(a) an internal mandrel rod for stretching said hollow ingots to form a tube bloom;

(b) a head at the forward end of said mandrel rod with at least one opening in said head; and (c) said at least one opening communicating with an axial passageway in said mandrel rod for introducing one of an inert gas and a non-oxidizing gas into the space being vacated by said mandrel rod head as said mandrel rod is being withdrawn from said bloom.

7. A method of manufacturing seamless tubes comprising the steps:

(a) piercing hot ingots with an internal piercing tool in one of a press and a skew rolling line to form a hollow ingot, with said skew rolling line having a hollow pusher ram and at least initially pushing said ingot into said skew rolling line with said hollow pusher ram;

(b) withdrawing the piercing tool from said hollow ingot;

(c) simultaneously introducing one of an inert gas and a non-oxidizing gas through at least one borehole in the forward end of said piercing tool or at least one opening in the forward end of said hollow pusher ram into the space in the hollow ingot being vacated by the withdrawal of the piercing tool as the piercing tool is withdrawn;

(d) elongating the hollow ingot to form a tubular bloom in one of a rolling mill and a push bench by forming the hollow ingot over a mandrel rod having a head at its forward end;

(e) withdrawing the mandrel rod from the hollow bloom while simultaneously introducing one of an inert gas and a non-oxidizing gas through at least one opening in the head of the mandrel rod to fill the space being vacated by the withdrawal of said head; and (f) finish rolling said hollow bloom to a tube.

* * * * *

UNITED STATES PATENT AND TRADEMARK OFFICE

CERTIFICATE OF CORRECTION

PATENT NO. : 4,928,507

DATED : May 29, 1990

INVENTOR(S) : KARLHANS STAAT, HERMANN MOLTNER

It is certified that error appears in the above-identified patent and that said Letters Patent is hereby corrected as shown below:

Column 1, line 11, change "or" to --of--.

Column 1, line 20, change "placed" to --pieced--.

Column 4, line 45, change "7" to --17--.

Column 5, line 24, change "for" to --to--.

Signed and Sealed this

Twenty-seventh Day of August, 1991

*Attest:*

HARRY F. MANBECK, JR.

*Attesting Officer*

*Commissioner of Patents and Trademarks*